US006371061B2

(12) United States Patent
Lash

(10) Patent No.: US 6,371,061 B2
(45) Date of Patent: Apr. 16, 2002

(54) HEAVY DUTY PISTON HAVING OIL SPLASH DEFLECTOR AND METHOD OF COOLING A PISTON

(75) Inventor: Mark S. Lash, Whitmore Lake, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/820,018

(22) Filed: Mar. 28, 2001

Related U.S. Application Data

(60) Provisional application No. 60/192,593, filed on Mar. 28, 2000.

(51) Int. Cl.[7] ..... F01P 1/04

(52) U.S. Cl. ..... 123/41.35; 123/193.6

(58) Field of Search ..... 123/41.35, 193.6; 92/186, 174

(56) References Cited

U.S. PATENT DOCUMENTS

| | | | | |
|---|---|---|---|---|
| 3,189,010 A | | 6/1965 | Isley | |
| 3,221,718 A | | 12/1965 | Isley | |
| 3,805,677 A | * | 4/1974 | Clary et al. | 92/190 |
| 4,129,108 A | | 12/1978 | Elsbett et al. | |
| 4,142,484 A | | 3/1979 | Buhl | |
| 4,207,808 A | * | 6/1980 | Elsbett et al. | 92/158 |
| 4,286,505 A | | 9/1981 | Amdall | |
| 4,593,660 A | * | 6/1986 | Elsbett et al. | 123/193.6 |
| 4,715,335 A | * | 12/1987 | Elsbett et al. | 123/41.35 |
| 4,847,964 A | | 7/1989 | Adams et al. | |
| 4,947,805 A | | 8/1990 | Steppat et al. | |
| 4,979,473 A | | 12/1990 | Lee | |
| 5,040,454 A | * | 8/1991 | Ballheimer et al. | 92/177 |
| 5,042,364 A | | 8/1991 | Okamura et al. | |
| 5,070,768 A | | 12/1991 | Goncalves et al. | |
| 5,546,896 A | | 8/1996 | Zaiser | |
| 5,692,430 A | | 12/1997 | McLaughlin et al. | |
| 5,917,418 A | | 6/1999 | Han | |
| 6,032,619 A | | 3/2000 | Zhu et al. | |
| 6,164,249 A | | 12/2000 | Honold et al. | |

FOREIGN PATENT DOCUMENTS

| | | |
|---|---|---|
| DE | 3732927 A1 | 4/1989 |

* cited by examiner

*Primary Examiner*—Marguerite McMahon
*Assistant Examiner*—Hyder Ali
(74) *Attorney, Agent, or Firm*—Reising, Ethington, Barnes, Kisselle, Learman & McCulloch, P.C.

(57) ABSTRACT

A piston assembly includes a piston head having an open bottom cooling gallery and a pair of pin bosses depending from the head and supporting a wrist pin of a connecting rod. A skirt is coupled to the pin bosses for reciprocation with the piston head. A stationary oil spray nozzle extends into the piston skirt from below and cooperates with an oil splash deflector which, at a lowered position of the piston head, directs the flow of oil onto the pin bosses for direct cooling, and at raised position of the piston head, moves out of the way to allow the cooling oil to enter the cooling gallery and cool the piston head.

12 Claims, 4 Drawing Sheets

HEAVY DUTY PISTON HAVING OIL SPLASH DEFLECTOR AND METHOD OF COOLING A PISTON

The disclosure incorporates the heavy duty piston having oil splash deflector and method of cooling a piston disclosed in provisional application No. 60/192,593, filed Mar. 28, 2000, whose priority date is claimed for this application.

BACKGROUND OF THE INVENTION

1. Technical Field

This invention relates generally to heavy duty pistons for diesel engine applications, and more particularly to the management of cooling oil in articulated pistons.

2. Related Art

Articulated pistons of conventional construction are often formed with a circumferentially extending cooling gallery in the piston head which is open to the bottom and communicates with one or more oil spray nozzles which extend into the skirt of the piston from below and direct a spray of cooling oil into the cooling gallery as the piston reciprocates in the piston cylinder to provide cooling. Lubrication of the pin bores and wrist pin are usually taken care of by internal oil porting. Any cooling of the pin bores and wrist pin are derived from the lubricating oil. In some applications, the pin bosses, their pin bores, bushings and wrist pin can be heated above desired temperatures which can impair the performance and longevity of the piston.

SUMMARY OF THE INVENTION AND ADVANTAGES

A piston assembly constructed according to the invention includes a piston head having an open bottom cooling gallery formed in a bottom surface of the piston head, a pair of pin bosses depending from the piston head and having pin bores for supporting a wrist pin of a connecting rod, a piston skirt coupled to the pin bosses for reciprocal movement with the piston head, and a stationary oil spray nozzle extending into the piston skirt and having an outlet position for directing a flow of cooling oil along a path toward the cooling gallery. An oil deflector shield is carried by the piston skirt in position to substantially obstruct the flow of cooling oil to the cooling gallery and to direct the obstructed flow onto the pin bosses when the piston head is moved to a lowered position. The oil deflector shield is positioned also to move substantially out of the path of the cooling oil to cause the cooling oil to be directed into the cooling gallery when the piston head is moved to a raised position.

The invention also contemplates a method of cooling a reciprocating piston which employs the mentioned deflector shield which operates to selectively obstruct the flow of cooling oil to the cooling gallery when the piston is at the bottom of stroke position in order to attain, during a portion of the piston stroke, direct cooling of the pin bore regions of the piston. This invention has the advantage of providing direct cooling to the cooling gallery of the piston head at times during the stroke of the piston when cooling of the head is needed most, namely when the piston is toward the top of stroke position where it sees the most heat and thus requires the most cooling. As the piston travels toward the bottom of stroke position, the piston head is moved away from the heat of combustion so as to lessen the cooling requirements and, according to the invention, the deflector is operative during this time to redirect the cooling oil onto the pin boss regions so that the pin boss regions are directly cooled at a time during the piston cycle when the cooling of the head is less critical.

The invention thus has the advantage of providing direct cooling of the pin boss regions without impairing the efficient cooling of the piston head.

The invention has the further advantage of achieving cooling of the piston head and pin bores with use of a single oil spray nozzle in conjunction with the deflector.

THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
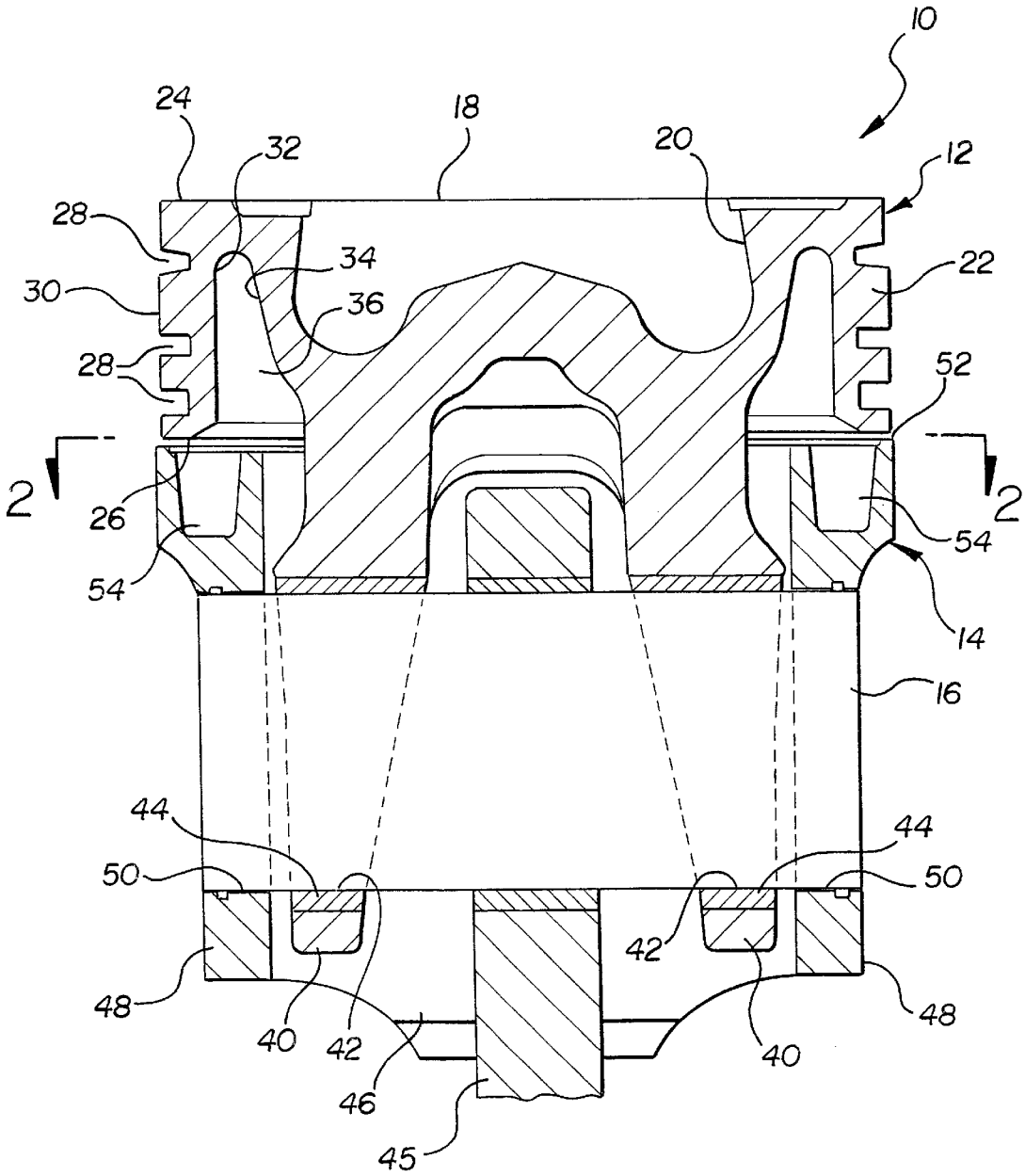
FIG. 1 is a cross-sectional view of a piston assembly constructed according to the invention shown coupled to a fragmentarily illustrated connecting rod.

Referring to the drawings, FIG. 1 shows an articulated piston assembly 10 having a head or crown 12 and a separately formed skirt 14 coupled to the crown 12 in the usual manner by a wrist pin 16.

Figure 2:
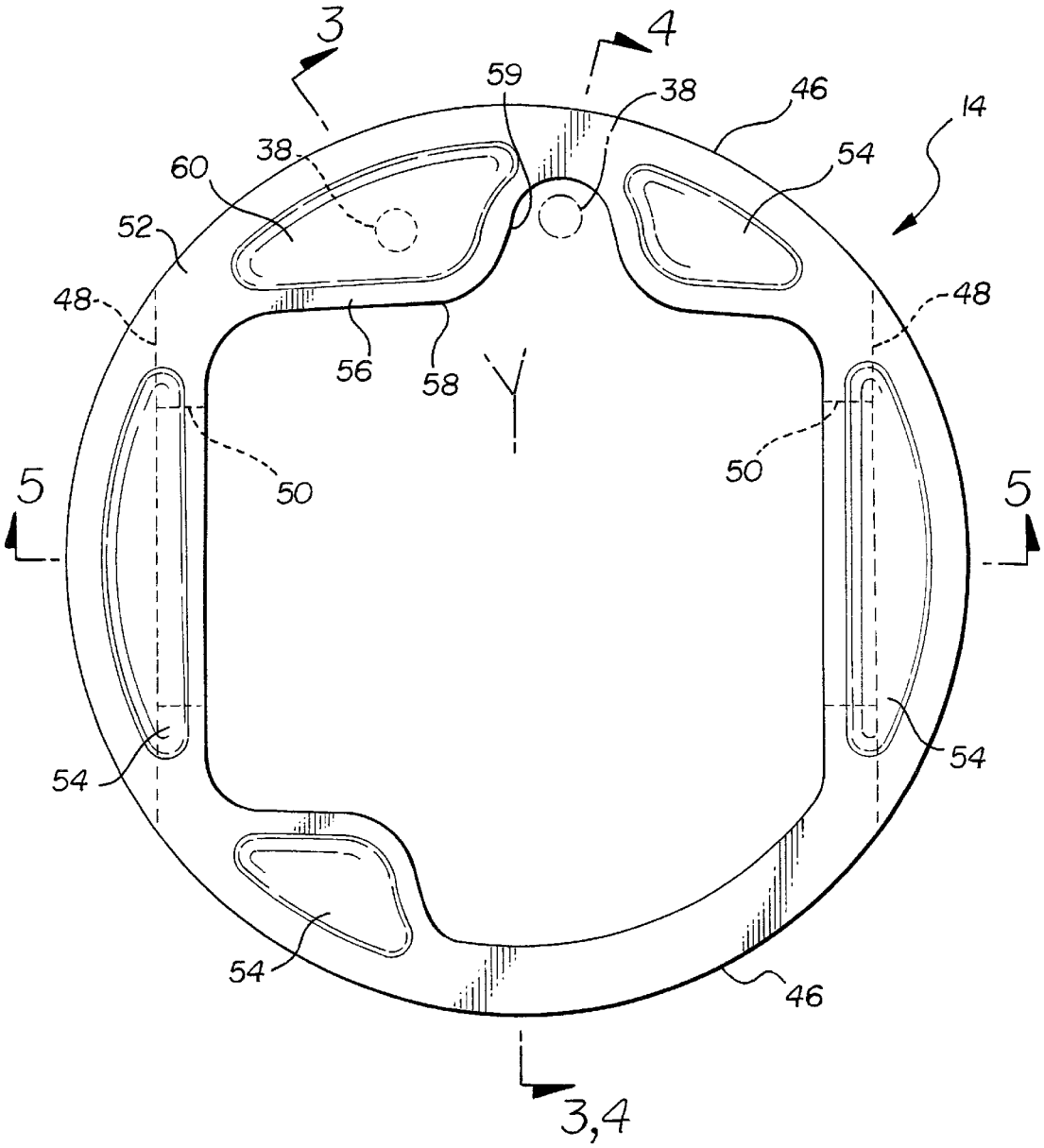
FIG. 2 is a plan view of the piston skirt as viewed generally along lines 2—2 of FIG. 1.
Figure 3:
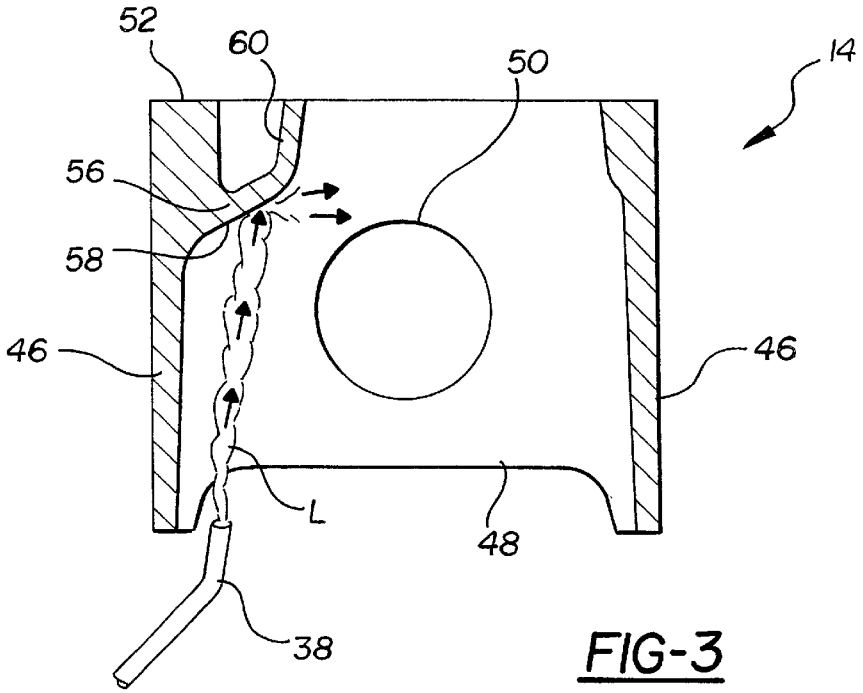
FIG. 3 is a sectional view taken generally along lines 3—3 of FIG. 2.

Referring also to FIGS. 2 and 3, the crown 12 has a central dome portion 18 with a contoured upper surface defining a combustion bowl 20. Surrounding the dome portion 18 is an annular ring belt portion 22 extending downwardly from an upper face 24 of the crown 12 to a lower face 26. A plurality of ring grooves 28 are formed in an outer surface 30 of the ring belt portion 22. Between the ring belt 22 and dome portion 18, radially spaced walls 32,34 define an oil cooling chamber or gallery 36 which, in this particular illustrated embodiment, is open to the bottom for receiving cooling oil L into the gallery 36 from below issuing from one or more oil spray nozzles 38 of an engine (not shown) in which the piston is mounted.

Figure 4:
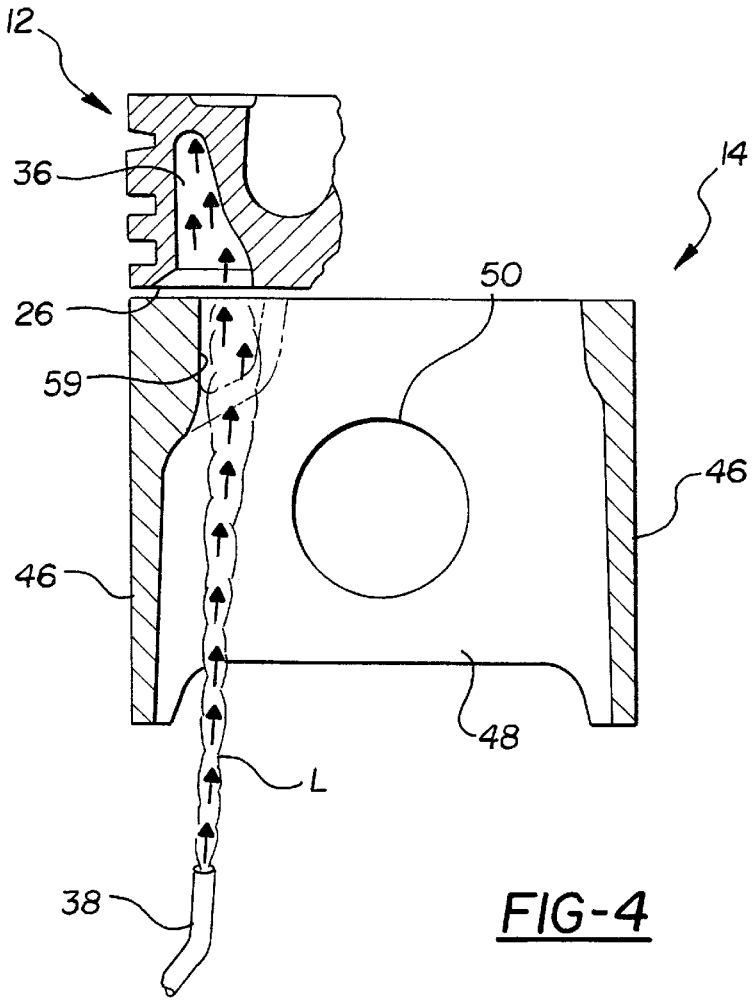
FIG. 4 is a sectional view taken generally along lines 4—4 of FIG. 2.
Figure 5:
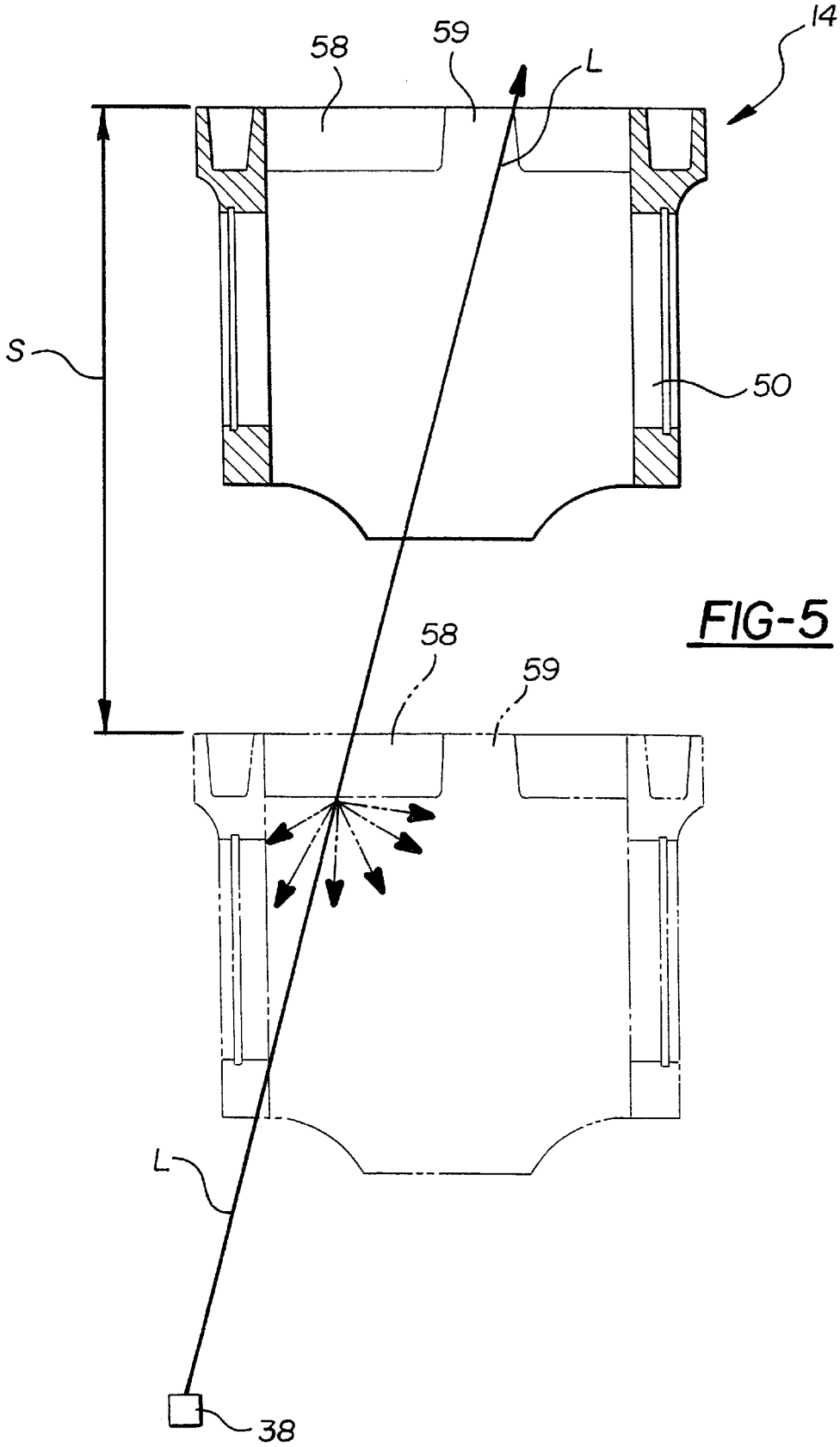
FIG. 5 is a sectional view taken generally along lines 5—5 of FIG. 2 showing the piston skirt moved between the upper solid line position and the lower broken line position with the stroke of the piston.

Extending downwardly from the dome portion 18 are a pair of laterally spaced pin bosses 40 formed with aligned pin bores 42 for accommodating the wrist pin 16. In many applications, including the illustrated embodiment, the pin bores 42 are lined with a bushing 44 to serve as a bearing surface for the wrist pin 16. However, not all applications will require the bushing 44 and the present invention can be practiced with or without the bushing 44. The wrist pin 16, of course, couples the piston assembly 10 to the upper end of a connecting rod 45 (schematically shown in FIG. 1) in the usual manner for reciprocating the piston assembly 10 within a cylinder bore (not shown) in typical manner by means of a crank shaft (not shown) with which the other end of a connecting rod 45 is coupled. FIG. 4 illustrates the skirt 14 of the piston assembly 10 near the top of its stroke, whereas FIG. 3 illustrates the piston assembly 10 near a mid stroke and on the way to a bottom of stroke position within the cylinder. FIG. 5 shows the skirt in both positions, with the upper solid line position representing the location of the skirt 14 near top dead center, and the broken chain line position representing the position of the skirt 14 near bottom dead center. The positioned relationship of the skirt relative to the fixed direction flow path of cooling oil L is also illustrated in FIG. 5, as will be discussed further below. The oil spray nozzle 38 is fixed relative to the reciprocating piston in thus the piston assembly 10 moves toward and away from the nozzle 38 in operation.

The piston skirt 14 has a pair of partial-cylindrical skirt portions 46 spaced radially outwardly of the pin bosses 40 joined by a pair of end walls 48 extending across the pin bosses 40 in laterally outwardly adjacent relation thereto. The end walls 48 have pin boss openings 50 aligned with the pin bores 42 of the pin bosses 40. Receipt of the wrist pin 16 in the pin boss openings 50 of the skirt operate to couple the skirt 14 to the crown 12 in articulated fashion, such that the skirt 14 is able to move or rock slightly relative to the crown 12 about the axis of the wrist pin 16. The skirt 14 has an upper face 52 that is spaced from the lower face 26 of the crown such that the skirt 14 is uncoupled from the crown 12 and joined only through the wrist pin 16. The crown 12 may be fabricated of steel, whereas the skirt 14 may be fabricated of aluminum or the like. Of course, other material selections are contemplated by the invention, including a steel crown in steel skirt, an aluminum crown and skirt, or variations thereof.

As best shown in FIG. 2, the upper end 52 of the skirt 14 is formed with at least one and preferably a plurality of oil reservoirs in the preferred form of cup formations 54 that project radially inwardly of the skirt portions 46 in circumferentially spaced relation to the oil spray nozzle or nozzles 38, so as to lie outside of the direct spray path of the nozzle, assuring that the cups 54 do not obstruct the direct flow of cooling oil issuing from the nozzle 38 from below into the oil cooling gallery 36. As the cooling oil runs out of the cooling gallery 36 through its open bottom, some of the oil is captured by the cups 54 so as to provide a "cocktail shaker action" which redirects the captured oil back into the cooling gallery 36 during rapid reciprocating movement of the piston assembly 10 during operation. The cups 54 are partitioned from one another such they form discrete reservoirs.

According to the invention, the skirt 14 is further fitted with an oil deflector 56 which operates at least during a portion of the stroke of the piston assembly 10 to direct all or some of the jet of cooling oil issuing from the spray nozzle 38 onto the wrist pin and pin boss portion 40 of the assembly 10 so as to cool the wrist pin 16 and the pin bosses 40, particularly in the vicinity of the pin bores 42 so as to cool the bearing surface between the pin bosses and wrist pins 16. In the illustrated example, the pin bores 42 are fitted with bushings 44, and the deflected oil serves to cool the bushings during operation.

The deflector 56 is similar in construction to the oil cooling cups 54, but is generally wider and oriented on the skirt 14 so as to lie in the path of the jet of cooling oil issuing from the spray nozzle 38 over a portion of the stroke S of the piston (see FIG. 5). The deflector 56 presents a deflector wall 58 projecting radially inwardly from the inner wall of the skirt portion 46, as shown best in FIGS. 2, 3 and 5. The deflector wall 58 is oriented relative to the oil spray nozzle 38 such that as the piston moves to an upper position toward the top of the stroke of the piston assembly 10 where the crown 12 is exposed to the hot combustion gases, (FIG. 3 and solid line position of FIG. 5) the angle of incidence of the oil spray issuing from the spray nozzle 38 allows a substantial flow of the oil L to pass by the deflector 58 and be directed into the cooling gallery 36 of the crown 12, for cooling the upper surface 24 and ring belt portion 22. Circumferentially adjacent the deflector 58 is a recess 59 which is positioned relative to the oil flow L so as to provide passage of the oil L around the deflector 58 and into the gallery 36 when the skirt 14 is moved with the piston to the upper position. As the piston moves downwardly in its stroke to a lowered position toward the bottom of stroke position, the deflector wall 58 enters the path of the oil stream L, as illustrated in FIGS. 2, 3 and 5, causing obstruction of the flow to the cooling gallery 36 such that a substantial portion of the oil stream L is deflected radially inwardly so as to splash onto the wrist pin 16, pin bosses 40 and the bushings 44 for cooling these regions of the piston assembly 10 during operation.

The nozzle 38 is disposed at an angle relative to the longitudinal axis of the piston skirt 14 (see FIG. 5) such that the oil flow L can bypass the deflector 58 as the piston 10 nears the top of stroke, while entering the path near the bottom of stroke to selectively deflect the oil flow.

The upper surface of the oil deflector 56 has a cup-like recess 60 which, like the cups 54, serves to capture oil running out of the cooling gallery 36 for redirecting such supplemental oil back into the cooling gallery for enhanced cooling.

In the preferred embodiment, the oil deflector feature 56 is formed as one piece with the piston skirt 14, and as such may be cast or forged therewith. Alternatively, the deflector feature 56 could take the form of a welded or bolted on component, although the one-piece structure is preferred.

Obviously, many modifications and variation of the present invention are possible in light of the above teachings. It is, therefore, to be understood that within the scope of the appended claims, the invention may be practiced otherwise than as specifically described. The invention is defined by the claims.

What is claimed is:

1. A piston assembly for an internal combustion engine, comprising:

a piston head supported for reciprocal movement in a piston cylinder between a lowered position and a raised position, said piston head having an open bottom cooling gallery formed in a bottom surface of said piston head;

a pair of pin bosses depending from said piston head and having pin bores for supporting a wrist pin of a connecting rod;

a piston skirt coupled to said pin bosses for said reciprocal movement with said piston head;

a stationary oil spray nozzle extending into said piston skirt and having an outlet positioned for directing a flow of cooling oil along a path toward said cooling gallery; and an oil deflector shield carried by said piston skirt and movable with said piston head relative to said stationary oil spray nozzle between a lowered deflecting position in the path of the cooling oil to substantially obstruct the flow of cooling oil to the cooling gallery and to direct the obstructed flow of cooling oil onto said pin bosses when the piston head is moved to said lowered position, and to a raised unobstructing position substantially out of the path of the flow of cooling oil to cause the cooling oil to be directed into the cooling gallery when the piston head is moved toward said raised position.

2. The piston assembly of claim 1 wherein said piston skirt has an inner wall and said oil splash deflector extends inwardly from said inner wall.

3. The piston assembly of claim 2 wherein said cooling gallery is formed by an annular groove having an inner annular groove wall and an outer annular groove wall.

4. The piston assembly of claim 3 wherein said piston head includes an outer peripheral surface formed with a plurality of ring grooves.

5. The piston assembly of claim 4 wherein said outer annular groove wall is adjacent said outer peripheral surface of said piston head.

6. The piston assembly of claim 1 wherein said skirt includes a recess circumferentially adjacent said oil splash deflector defining a passage for the oil when said skirt is in said lowered position.

7. The piston assembly of claim 6 wherein said oil delivery tube is supported at an angle relative to said recess.

8. The piston assembly of claim 1 wherein said piston skirt has an upper end surface formed with at least one oil collection reservoir.

9. The piston assembly of claim 8 wherein said piston skirt includes a plurality of said oil collection reservoirs.

10. The piston assembly of claim 9 wherein said plurality of said oil collection reservoirs are partitioned from one another.

11. The piston assembly of claim 10 wherein one of said oil collection reservoirs is provided in an upper surface of said oil splash deflector.

12. A method of cooling a piston while reciprocating in a piston cylinder between a raised and lowered position and which includes a piston head having an open bottom circumferentially extending cooling gallery, a pair of pin bosses depending from the piston head and having a pair of pin bores in which a wrist pin of a connecting rod is received, and a piston skirt connected to the pin bosses for reciprocal movement with the piston head, said method comprising:

extending a stationary oil delivery tube into the piston skirt from below; and providing an oil splash deflector on the piston skirt which is sized and positioned relative to the cooling gallery, the piston skirt, the pin bosses, and the oil delivery tube so as to substantially obstruct a flow of cooling oil issuing from the oil delivery tube from passing into the cooling gallery when the piston is in the lowered position and deflecting such oil onto the pin bosses and pin bores when in such lowered position, and further so as to move out of the path of the flow of cooling oil when the piston is moved to the raised position to cause the cooling oil to enter the cooling gallery when in such raised position.

* * * * *